US009393812B2

(12) United States Patent
Akatsuka

(10) Patent No.: US 9,393,812 B2
(45) Date of Patent: Jul. 19, 2016

(54) IMAGE FORMING APPARATUS

(71) Applicant: Brother Kogyo Kabushiki Kaisha, Nagoya-shi, Aichi-ken (JP)

(72) Inventor: Yasunori Akatsuka, Mizuho (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 21 days.

(21) Appl. No.: 14/480,719

(22) Filed: Sep. 9, 2014

(65) Prior Publication Data

US 2015/0068865 A1 Mar. 12, 2015

(30) Foreign Application Priority Data

Sep. 10, 2013 (JP) ..... 2013-187102

(51) Int. Cl.
*G03G 15/00* (2006.01)
*B41J 11/00* (2006.01)

(52) U.S. Cl.
CPC ..... *B41J 11/0045* (2013.01); *B41J 11/0095* (2013.01)

(58) Field of Classification Search
None
See application file for complete search history.

(56) References Cited

U.S. PATENT DOCUMENTS 6,980,766 B2 * 12/2005 Ito ..... G03G 15/234 271/226
2011/0236100 A1 9/2011 Yamamoto

FOREIGN PATENT DOCUMENTS

| | | | |
|---|---|---|---|
| JP | S58-137863 | A | 8/1983 |
| JP | H01-139447 | A | 5/1989 |
| JP | 2011-203451 | A | 10/2011 |

* cited by examiner

*Primary Examiner* — Kavel Singh
(74) *Attorney, Agent, or Firm* — Banner & Witcoff, Ltd.

(57) ABSTRACT

Aspects of the disclosure provide an image forming apparatus. The image forming apparatus has a first conveying path and a second conveying path which joins the first conveying path. The image forming apparatus includes an actuator configured to be pivoted by a recording sheet conveyed through the first conveying path. The image forming apparatus further includes ribs disposed adjacent to the actuator in an axial direction of the actuator. The image forming apparatus has a first recess which faces at least one of the ribs and is recessed in a direction opposite to the conveying direction.

12 Claims, 7 Drawing Sheets

IMAGE FORMING APPARATUS

CROSS-REFERENCE TO RELATED APPLICATION

This application claims priority from Japanese Patent Application No. 2013-187102, filed on Sep. 10, 2013, which is incorporated herein by reference in its entirety.

TECHNICAL FIELD

Aspects disclosed herein relate to an image forming apparatus having a first conveying path and a second conveying path which joins the first conveying path.

BACKGROUND

An image forming apparatus known in the prior art includes a conveying path, through which paper is conveyed to an image forming unit, and a re-conveying path, which joins the conveying path on the upstream side of the image forming apparatus in a conveying direction. This type of image forming apparatus has an actuator that detects paper, the actuator being disposed near the downstream side of the junction between the conveying path and the re-conveying path in the conveying direction. If the conveying path is wide at a position at which the actuator is disposed, the top of paper is likely to pass various positions, so the top is likely to come into contact with the actuator at various positions. This causes the actuator to tend to operate at various times.

In view of this, if ribs protruding upward are provided at both sides of the actuator to narrow the conveying path at the position of the actuator by an amount by which the ribs protrude, the conveyed paper is less likely to come into contact the actuator at various positions. This enables the actuator to detect the paper more accurately.

If, however, the above rib is provided in an image forming apparatus so that the rib extends to the re-conveying path, it is narrowed at a position immediately before the junction between the conveying path and the re-conveying path. This may cause an increase in a resistance that prevents paper from being easily conveyed through the conveying path on the upstream side of the rib in the conveying direction.

SUMMARY

Aspects of the disclosure provide an image forming apparatus. The image forming apparatus has a first conveying path and a second conveying path which joins the first conveying path. The image forming apparatus includes an actuator configured to be pivoted by a recording sheet conveyed through the first conveying path. The image forming apparatus further includes ribs disposed adjacent to the actuator in an axial direction of the actuator. The image forming apparatus has a first recess which faces at least one of the ribs and is recessed in a direction opposite to the conveying direction.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

Preferred embodiment of the present invention will be described with reference to the attached drawings. The general structure of a laser printer 1 will be described first, after which characteristic parts of the present invention will be described.

Figure 1:
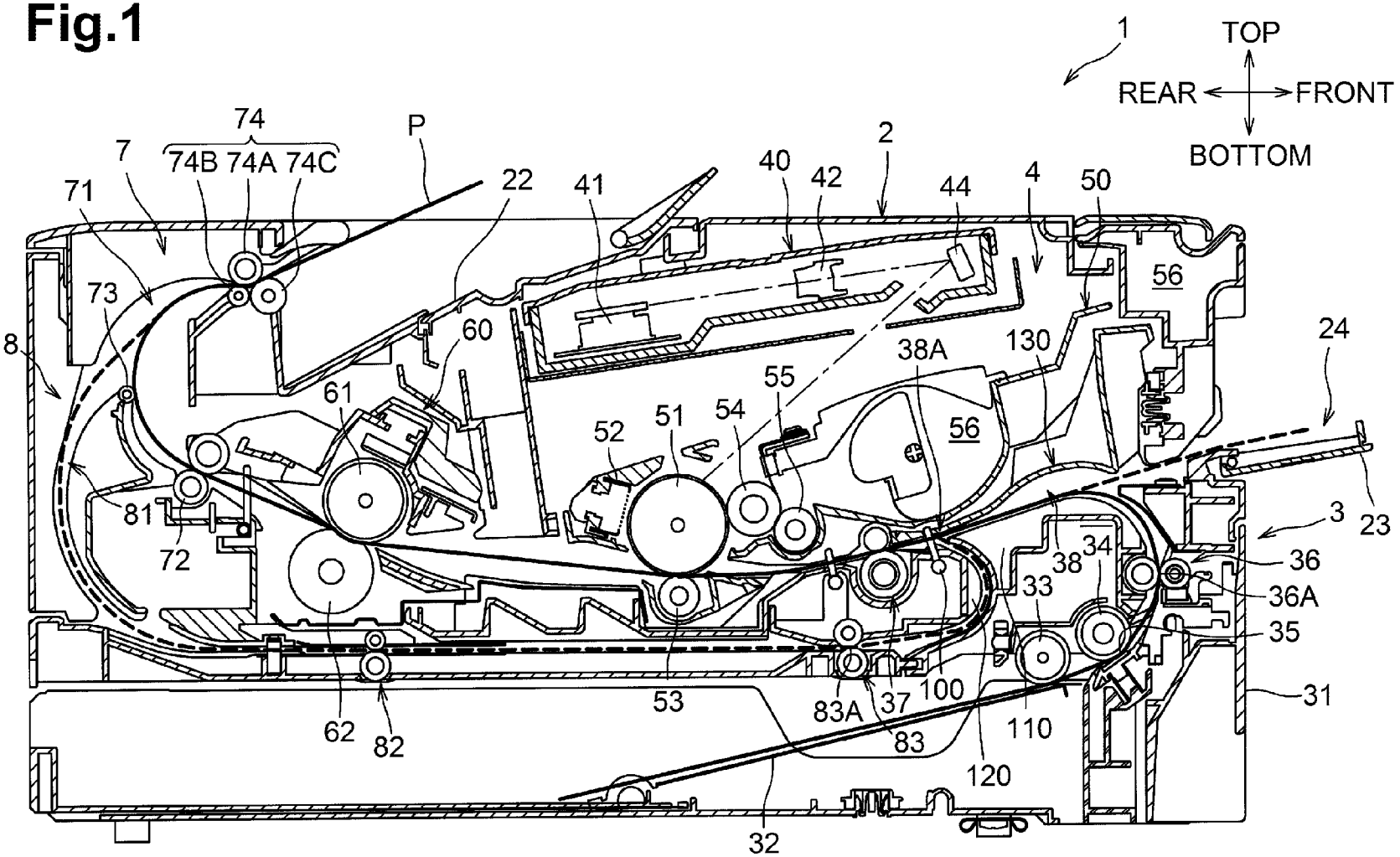
FIG. 1 is a cross sectional view of a laser printer in an embodiment of the present invention.

The laser printer 1 is structured so that an image can be formed on both sides of paper P as illustrated in FIG. 1. The laser printer 1 includes a paper feed unit 3, an image forming unit 4, a discharging unit 7, and an inverting unit 8 in a case 2.

Directions in the descriptions below are relative to the user who uses the laser printer 1. Specifically, the right side in FIG. 1 is "front", the left side is "back", the front is "left", and the back is "right". The vertical direction in FIG. 1 is "vertical". The conveying direction in the descriptions below is a direction in which paper P is conveyed in a supply path 38.

A front cover 23, which is pivotable away from and toward the case 2, is provided on the front of the case 2. A manually inserted tray 24 is provided inside the front cover 23. When the front cover 23 is opened toward the front, paper P can be manually placed on the manually inserted tray 24.

The paper feed unit 3, disposed at the bottom of the case 2, is structured so that paper P is supplied to the image forming unit 4. The main components of the paper feed unit 3 are a feed tray 31, a paper pressing plate 32, a pickup roller 33, a separating roller 34, a separating pad 35, a conveying roller pair 36, an actuator 100, a resist roller pair 37, and the supply path 38.

The supply path 38 (an example of a first conveying path) guides paper P from the feed tray 31 toward the image forming unit 4, specifically, toward a clearance between a photosensitive drum 51 and a transfer roller 53. The supply path 38 extends from the vicinity of the pickup roller 33 toward the conveying roller pair 36 disposed upward at an angle on the front side, is curved backward at a nip position 36A of the conveying roller pair 36, and extends toward a clearance between the photosensitive drum 51 and the transfer roller 53. In other words, the supply path 38 is substantially U-shaped so as to extend from the feed tray 31 toward the image forming unit 4.

Part of the supply path 38 extends toward the photosensitive drum 51 disposed downstream of the nip position 36A of the conveying roller pair 36 in the conveying direction. The walls of the supply path 38 in this range are mainly formed with a first guide 110, a second guide 120, and a third guide 130. The first guide 110, second guide 120, and third guide 130 will be described later in detail.

The actuator 100 is provided to detect a pass of paper P in the supply path 38 when the paper P comes into contact with the actuator 100. The actuator 100 is disposed upstream of the resist roller pair 37 in the supply path 38 in the conveying direction and downstream of a junction 38A, at which the supply path 38 joins a re-conveying path 81 (an example of a second conveying path), which will be described later, in the conveying direction. The actuator 100 is disposed so as to be pivotable away from and toward the second guide 120. When conveyed paper P comes into contact with the actuator 100, it falls backward. When the paper P has completely passed the actuator 100, it returns to its original position.

Figure 3:
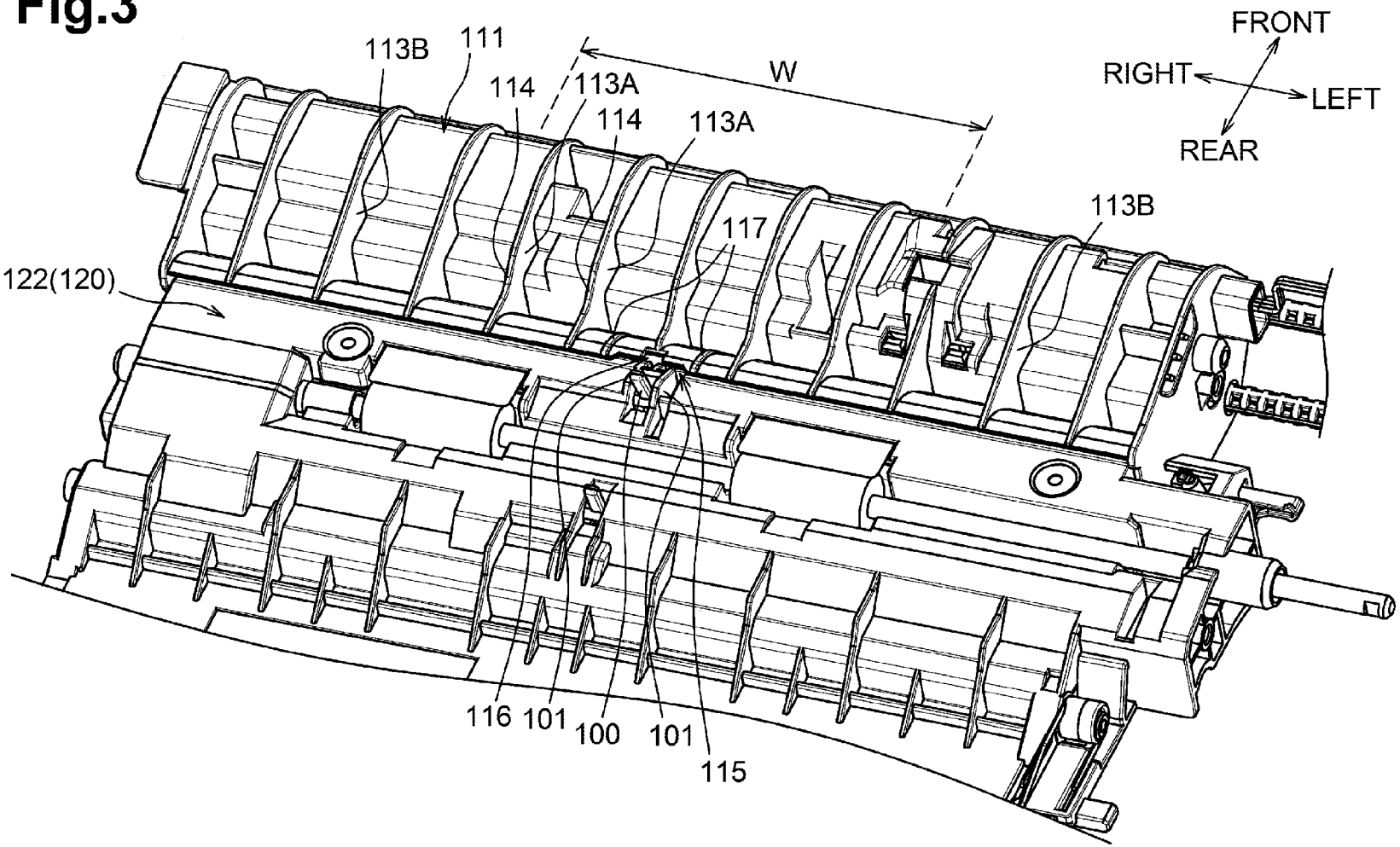
FIG. 3 is a perspective view of a first guiding portion and a fourth guiding portion when viewed from above.

The actuator 100 is placed substantially at the center of the second guide 120 in the right and left direction as illustrated in FIG. 3. Ribs 101, which extend in the conveying direction, are provided adjacent to the actuator 100 and at both ends of the actuator 100.

Paper P placed on the feed tray 31 is moved by the paper pressing plate 32 toward the pickup roller 33 and is then fed out by the pickup roller 33 to the supply path 38. Sheets of paper P that have been fed out are separated by the separating roller 34 and separating pad 35 one sheet at a time. The separated paper P is conveyed by the conveying roller pair 36. The skew of the paper P is corrected by the resist roller pair 37, after which the paper P is conveyed toward the image forming unit 4, specifically, toward a clearance between the photosensitive drum 51 and the transfer roller 53.

The image forming unit 4, disposed above the feed tray 31, is structured so as to form an image on the supplied paper P. The image forming unit 4 mainly includes an exposing unit 40, a process cartridge 50, and a fixing unit 60.

The exposing unit 40 is disposed at an upper portion in the case 2. The exposing unit 40 mainly includes a laser emitting unit (not illustrated), a polygon mirror 41, which is rotationally driven, a lens 42, and a reflecting minor 44. Laser light is emitted from the laser emitting unit according to image data, passes through the polygon minor 41 and lens 42 in that order, and is reflected at the reflecting mirror 44, as indicated by the dash-dot lines in FIG. 1. The surface of the photosensitive drum 51 is then scanned with the reflected laser light at high speed.

The process cartridge 50, disposed below the exposing unit 40, can be attached to and removed from the case 2 through an opening that is formed when the front cover 23 attached to the case 2 is opened, enabling the process cartridge 50 to be replaced. The process cartridge 50 mainly includes the photosensitive drum 51, a charger 52, the transfer roller 53, a developing roller 54, a supply roller 55, and a toner storage unit 56, which stores toner.

The fixing unit 60, disposed behind the process cartridge 50, includes a heating roller 61 and a pressure roller 62, which is disposed opposite to the heating roller 61 to press it.

In the image forming unit 4, after the surface of the photosensitive drum 51 has been uniformly charged by the charger 52, the surface is exposed with high-speed scan of laser light emitted from the exposing unit 40, forming an electrostatic latent image on the photosensitive drum 51. Toner in the toner storage unit 56 is supplied through the supply roller 55 to the developing roller 54 and is supported on the developing roller 54.

The toner supported on the developing roller 54 is supplied to the electrostatic latent image formed on the photosensitive drum 51 to make the electrostatic latent image visible, forming a toner image on the photosensitive drum 51. When the paper P supplied from the paper feed unit 3 is conveyed through a clearance between the photosensitive drum 51 and the transfer roller 53, the toner image is transferred from the photosensitive drum 51 onto the paper P. When the paper P is then conveyed through a clearance between the heating roller 61 and the pressure roller 62, the toner image transferred onto the paper P is thermally fixed.

The discharging unit 7 is structured so as to convey, toward the outside of the case 2, the paper P on which the toner image has been thermally fixed. The discharging unit 7 mainly includes a discharge path 71, a conveying roller 72, an auxiliary conveying roller 73, and a discharge roller 74.

The discharge path 71 is a path through which the paper P conveyed from the fixing unit 60 is guided toward a discharge tray 22 while the paper P is curved.

The discharge roller 74, disposed in the vicinity of the exit of the discharge path 71, is structured so as to be rotatable in the normal and reverse directions under known control. Specifically, when rotated in the normal direction, the discharge roller 74 discharges paper P toward the outside of the case 2; when rotated in the opposite direction, the discharge roller 74 conveys paper P to the inverting unit 8.

The discharge roller 74 includes a driving roller 74A, which receives a driving force, and driven rollers 74B and 74C, which are disposed below the driving roller 74A and are driven by the driving roller 74A.

In the discharging unit 7, the paper P discharged from the image forming unit 4 as indicated by the sold line in FIG. 1, an image having been formed on the paper P, is conveyed toward the discharge roller 74 along a path that is curved from the upward orientation at an angle behind the discharge roller 74 toward the front. Upon completion of image forming only on one side or on both sides, the paper P enters the discharge path 71 downstream of the image forming unit 4 in the conveying direction, is curved in a substantially U-shaped form, and is discharged to the discharge tray 22 disposed at an upper portion of the case 2.

When an image is formed on both sides of paper P, it is first conveyed by the discharge roller 74 that is rotated in the normal direction toward the outside of the case 2. Since the discharge roller 74 is rotated in the reverse direction before the entire paper P is completely discharged to the outside of the case 2, the paper P is drawn into the case 2 again and is conveyed to the inverting unit 8 as indicated by the broken line in FIG. 1.

The inverting unit 8 conveys inverted paper P toward the image forming unit 4 again during image forming on both sides of the paper P. The inverting unit 8 mainly includes the re-conveying path 81 and re-conveying roller pairs 82 and 83.

The re-conveying path 81 is a path through which paper P with an image formed on one side is guided toward the supply path 38 by rotating the discharge roller 74 in the reverse direction. Specifically, the re-conveying path 81 branches from the vicinity of the back end of the d discharge path 71, extends downward, is curved toward the front, extends above the feed tray 31 from its back toward its front, passes the re-conveying roller pair 82 on the back side, and extends to the re-conveying roller pair 83 on the front side. Furthermore, the re-conveying path 81 is curved upward from the nip position 83A of the re-conveying roller pair 83 on the front side, is U-turned, and joins the junction 38A of the supply path 38.

In the inverting unit 8, the paper P conveyed by the reverse rotation of the discharge roller 74 is conveyed along the re-conveying path 81 as indicated by the broken line in FIG. 1, feeding out the paper P to the supply path 38 again to convey it to the image forming unit 4. An image is then formed on the back of the paper P in the image forming unit 4 as indicated by the solid line in FIG. 1, after which the paper P is discharged to the outside of the case 2 by the discharging unit 7 and is placed on the discharge tray 22.

Figure 2:
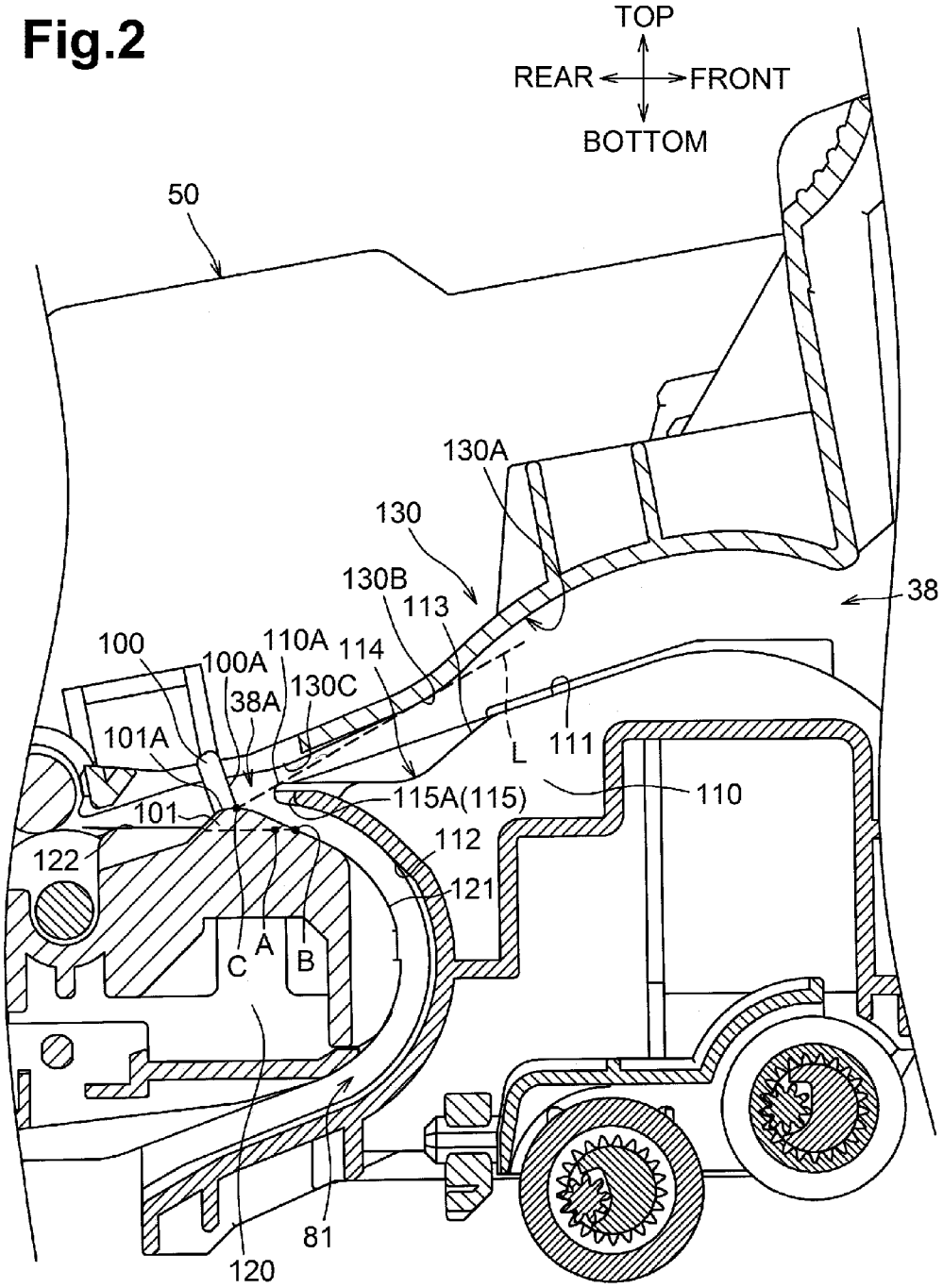
FIG. 2 is an enlarged view illustrating the actuator in FIG. 1 and its peripheral portions.

As illustrated in FIG. 2, the first guide 110 forms the re-conveying path 81 and the supply path 38 starting from the junction 38A toward the upstream end in the conveying direction, the first guide 110 being disposed below the third guide 130. The first guide 110 includes a first guiding portion 111, which guides a surface of paper P conveyed through the supply path 38, the surface facing the transfer roller 53, and also has a second guiding portion 112, which guides a surface of paper P conveyed through the re-conveying path 81.

The first guiding portion 111 is curved backward from above the conveying roller pair 36, extends backward to the junction 38A (see also FIG. 1).

The second guiding portion 112 is U-shaped; it extends downward at an angle toward the front from the back end of the first guiding portion 111, that is, the downstream end 110A of the first guide 110, and is then curved backward.

As illustrated in FIGS. 2 and 3, a plurality of guide ribs 113, which extend in the conveying direction, are provided immediately upstream of the junction 38A in the first guiding portion 111 in the conveying direction in such a way that the guide ribs 113 are arranged in the right and left direction. Of the plurality of guide ribs 113, guide ribs 113A are disposed in a predetermined range W, including a range in which the actuator 100 is placed, in the right and left direction, and guide ribs 113B are disposed outside the predetermined range W in the right and left direction. Each guide rib 113A has a rib curved portion 114, which is recessed downward in such a way that the guide rib 113A is located more away from the third guide 130 than the guide rib 113B.

The predetermined range W may be about 100 mm to 110 mm to match, for example, the length of a postcard in the right and left direction.

Figure 4A:
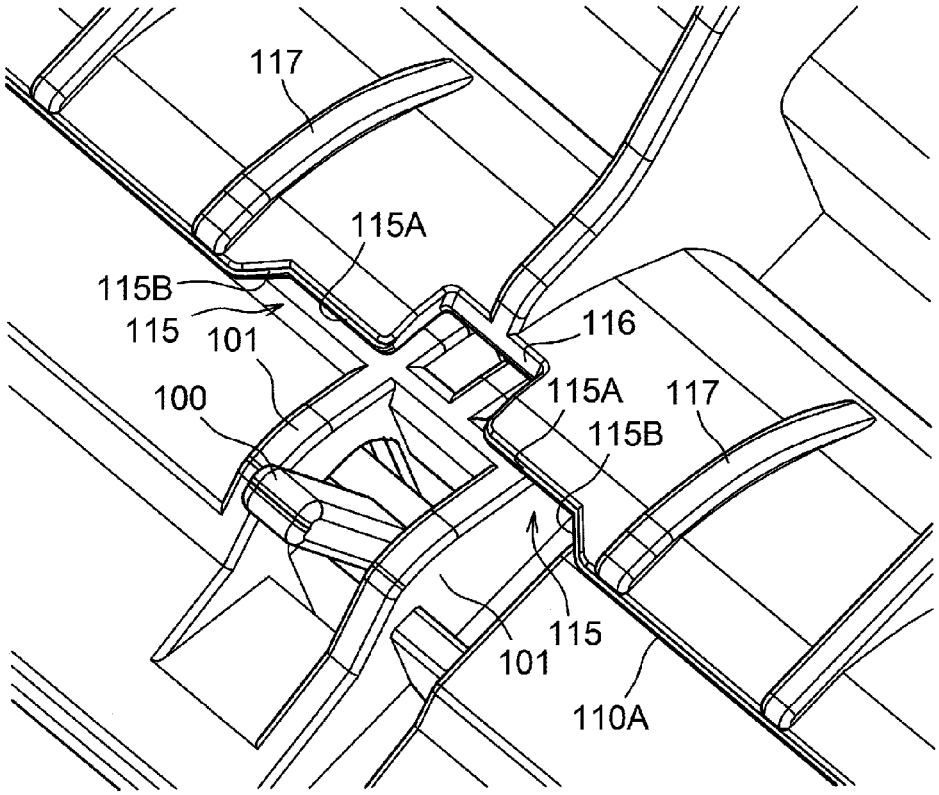
FIG. 4A is an enlarged perspective view of the actuator and its peripheral portions when viewed from above.
Figure 4B:
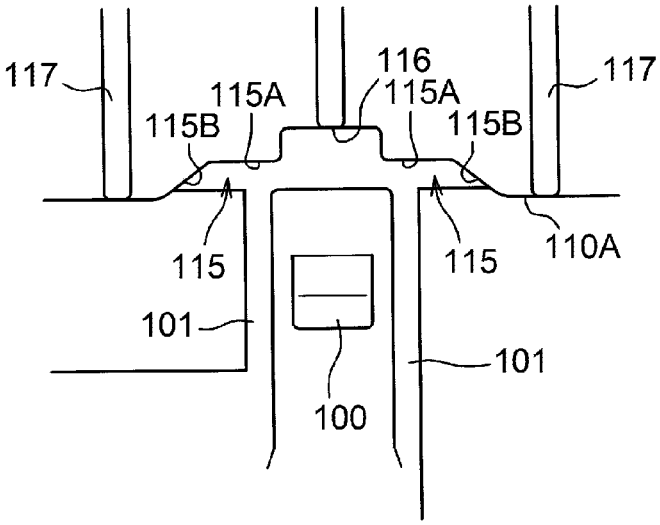
FIG. 4B is a view of the actuator and its peripheral portions when viewed directly above.

As illustrated in FIGS. 3, 4A, and 4B, the first guide 110 has first recesses 115, a second recess 116, and downstream ribs 117 substantially at the center of the downstream end 110A of the first guide 110.

Each first recess 115 is disposed at a position at which it faces the relevant rib 101 in the conveying direction, specifically, in correspondence to a position at which the relevant rib 101 is placed in the right and left direction. The first recess 115 is recessed toward the upstream side in the conveying direction. The first recess 115 has a bottom 115A and also has an inclined portion 115B at one end of the bottom 115A in the right and left direction. The inclined portion 115B on the right side in the right and left direction is inclined outward in the right direction as it extends toward the downstream side in the conveying direction. Similarly, the inclined portion 115B on the left side in the right and left direction is inclined outward in the left direction as it extends toward the downstream side in the conveying direction.

The second recess 116 is disposed at a position at which it faces the actuator 100 in the conveying direction inside the bottoms 115A of the first recess 115, specifically, in correspondence to a position at which the actuator 100 is placed in the right and left direction. The second recess 116 is more recessed toward the upstream side in the conveying direction than the bottoms 115A of the first recess 115.

A pair of downstream ribs 117 are provided outside the first recesses 115 in the first guiding portion 111 in the right and left direction so as to extend in the conveying direction.

As illustrated in FIG. 2, the second guide 120 forms the re-conveying path 81 and the supply path 38 starting from the junction 38A toward the downstream end in the conveying direction, the second guide 120 being disposed so as to be adjacent to the first guide 110 in the fore-and-aft direction. The second guide 120 has a third guiding portion 121, which guides a side of paper P on which an image has been formed, the paper P being conveyed through the re-conveying path 81, and also has a fourth guiding portion 122, which guides the back of paper P to be conveyed through the supply path 38.

The third guiding portion 121 extends upward at an angle toward the front from the front of the re-conveying roller pair 83 on the front side, is curved backward, and then extends to a position A substantially directly below the downstream end 110A of the first guide 110 (see also FIG. 1). The third guiding portion 121, which is disposed opposite to the second guiding portion 112, forms the re-conveying path 81 together with the second guiding portion 112.

The fourth guiding portion 122 extends backward from the position A in the third guiding portion 121.

The third guide 130 guides a side of paper P that faces the photosensitive drum 51, the paper P being conveyed through the supply path 38 from the upstream side toward the downstream side in the conveying direction. The third guide 130, which is disposed opposite to the first guiding portion 111 and fourth guiding portion 122, forms the supply path 38 together with the first guiding portion 111 and fourth guiding portion 122.

Figure 5:
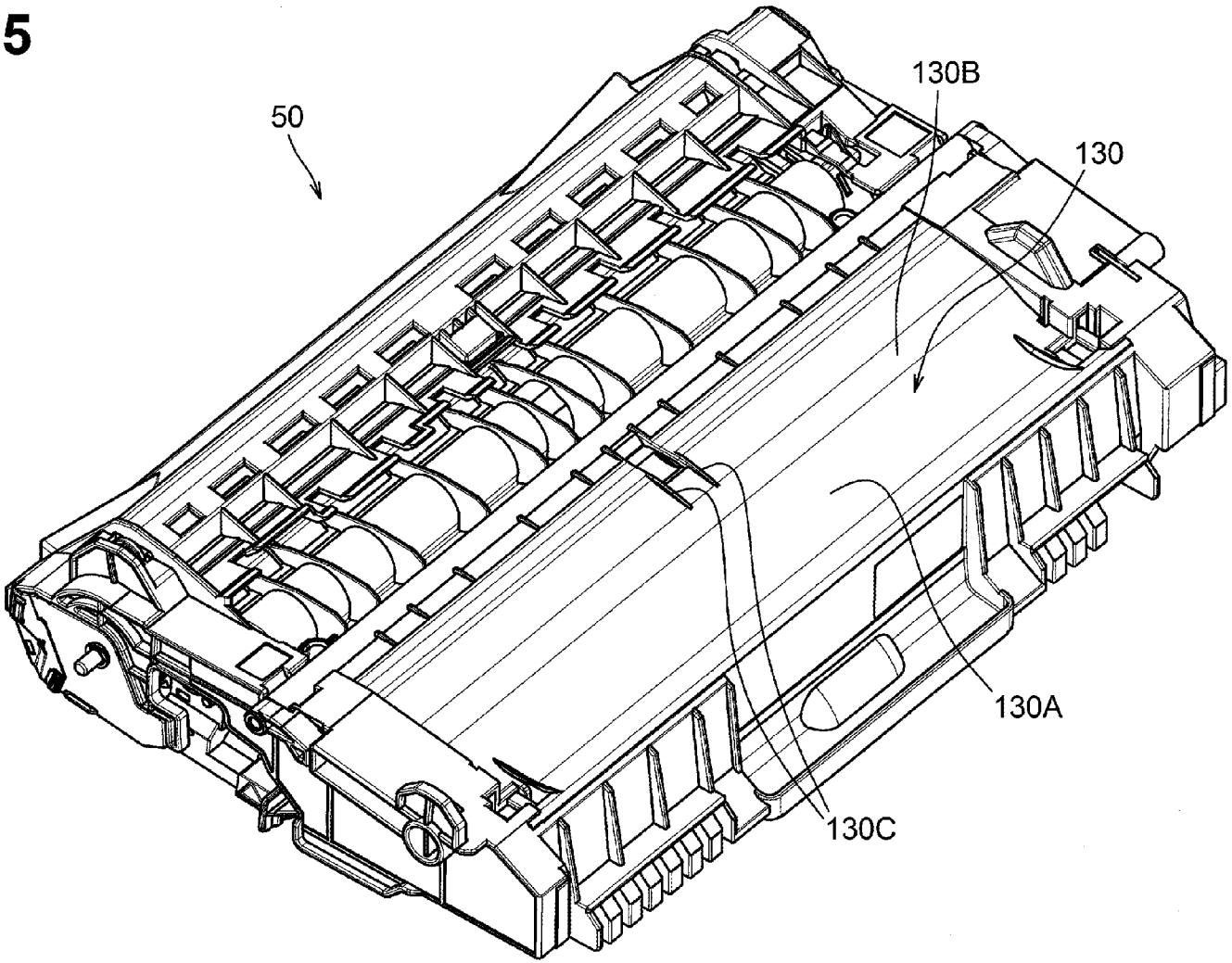
FIG. 5 is a perspective view of a process cartridge when viewed from below.

As illustrated in FIGS. 2 and 5, the third guide 130 is formed with the bottom surface of the process cartridge 50. The third guide 130 has a recess 130A, a ridge 130B, and a pair of cartridge ribs 130C at a portion that faces the first guide 110 disposed upstream of the junction 38A in the conveying direction. The recess 130A is curved upward so as to be recessed at a portion that faces the first guiding portion 111. The ridge 130B, which is formed behind the recess 130A, is curved in a convex form toward the first guiding portion 111. The cartridge rib pair 130C is disposed behind the ridge 130B.

The ridge 130B is formed at a position at which it faces the rib curved portions 114. Each of the cartridge rib pair 130C is disposed at a position at which it faces the relevant rib 101 and first recess 115 in the right and left direction. The cartridge rib 130C is at the same position as the first recess 115 in the conveying direction.

Next, the structure of the actuator 100 and its peripheral portions will be described. As illustrated in FIG. 2, the actuator 100 is inclined backward and extends from the fourth guiding portion 122 toward the third guide 130. The surface of the actuator 100 on the upstream side in the conveying direction is an abutting surface 100A, which comes into contact with paper P.

Each rib 101 bridges the third guiding portion 121 and fourth guiding portion 122 and protrudes upward. Specifically, the rib 101 is disposed in a range from a position B on the third guiding portion 121 disposed substantially directly below the bottom 115A of the first recess 115 of the first guide 110 to a position, on the fourth guiding portion 122, that is on the downstream side of the actuator 100 in the conveying direction. Thus, the supply path 38 and re-conveying path 81 at the position at which the rib 101 is disposed is narrowed by an amount by which the rib 101 protrudes.

As illustrated in FIG. 2, the rib 101 is disposed so that a position C, at which the abutting surface 100A of the actuator 100 and a surface, of the rib 101, that faces the third guide 130 cross each other, becomes the same as a position of the upper surface 101A of the rib 101 at which the rib 101 most protrudes toward the third guide 130. Accordingly, the actuator 100 comes into contact with paper P at a portion at which the supply path 38 is most narrowed, enabling a position at which paper P comes into contact to be easily fixed.

A straight line L that connects the ridge 130B and the position C, at which the abutting surface 100A of the actuator 100 and the upper surface 101A of the rib 101 cross each other, is tangent to the downstream end 110A of the first guide 110. In other words, the straight line L, which is tangent to the ridge 130B and the downstream end 110A of the first guide 110, crosses the abutting surface 100A of the actuator 100, the abutting surface 100A protruding toward the third guide 130 beyond the rib 101, when viewed in the right and left direction. Accordingly, paper P that has been conveyed from the supply path 38 is likely to come into contact with the actuator 100.

If the downstream end 110A of the first guide 110 further extends toward the downstream end in the conveying direction, the abutting surface 100A and straight line L become likely to cross each other. In this case, it is possible to more reliably bring paper P into contact with the abutting surface 100A.

Accordingly, effects as described below can be obtained in this embodiment. Since each first recess 115 is disposed at a position at which it faces the relevant rib 101 of the first guide 110, it is possible to suppress the space of the re-conveying path 81 from being narrowed on the upstream side of the rib 101 in the conveying direction. Therefore, it is possible to suppress an increase in a resistance that prevents paper P from being easily conveyed through the re-conveying path 81 on the upstream side of the rib 101 in the conveying direction.

Since a portion, other than the first recesses 115, of the downstream end 110A of the first guide 110 can be extended toward the downstream side in the conveying direction, paper P can be easily guided accurately toward the actuator 100.

Since the second recess 116 is disposed at a position at which it faces the actuator 100, even if the actuator 100 pivots toward the upstream end in the conveying direction, it is possible to suppress the first guide 110 from interfering with the actuator 100. Therefore, when a portion, other than the second recess 116, of the downstream end 110A of the first guide 110 is extended toward the downstream end in the conveying direction, paper P can be easily guided accurately to the actuator 100.

Since paper P is less likely to come into contact with the actuator 100 at different positions, a timing at which the actuator 100 operates in response to the movement of paper P can be brought close to a certain value, so the actuator 100 can more accurately detect paper P.

Since the straight line L, which is tangent to both the ridge 130B and the downstream end 110A of the first guide 110, crosses the abutting surface 100A of the actuator 100, paper P can be easily guided accurately toward the abutting surface 100A of the actuator 100 while the paper P is being conveyed.

Figure 6:
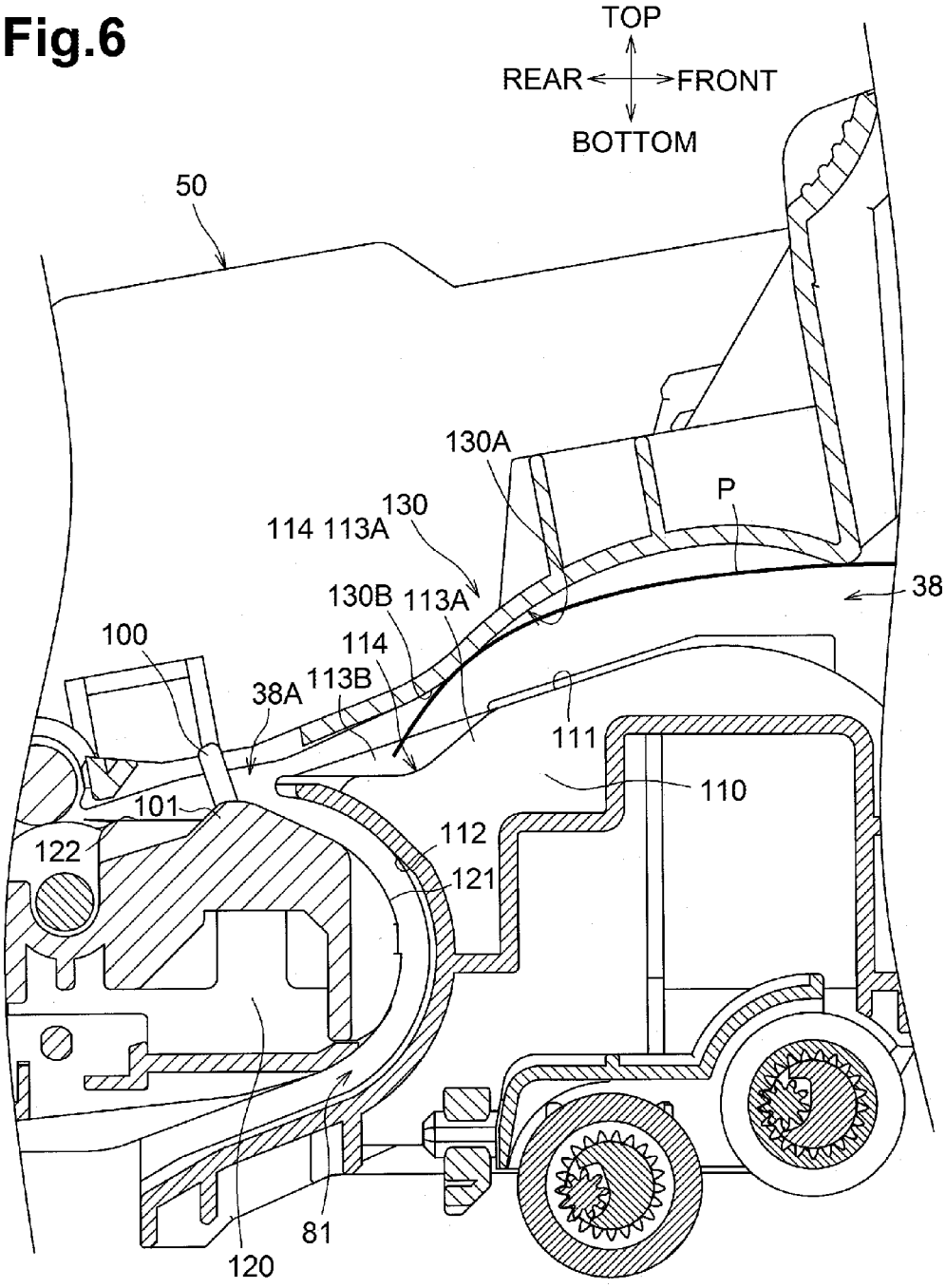
FIG. 6 illustrates how the top of paper enters a rib curved portion.

Paper P with a small width such as a postcard may be conveyed while the front end of the paper P is curled downward, as illustrated in FIG. 6. Then, the front end of the paper P is likely to collide with the guide ribs 113B disposed upstream of the ribs 101 in the conveying direction, so the paper P is likely to jam in the supply path 38 at the positions at which the ribs 101 are disposed and the supply path 38 is thereby narrowed. In this embodiment, however, each guide rib 113A within the predetermined range W has the rib curved portion 114, enabling the front end of the paper P to escape into the curved portions 114. Therefore, it is possible to suppress paper P from jamming in the supply path 38 at the positions at which the ribs 101 are disposed and the supply path 38 is thereby narrowed.

The cartridge ribs 130C are disposed on a surface, of the process cartridge 50, that faces the supply path 38. The cartridge ribs 130C restrict the movement of paper P toward the process cartridge 50, so the paper P is less likely to come into contact with the actuator 100 at different positions. Since the first recesses 115 are disposed at the positions corresponding to the cartridge ribs 130C in the right and left direction, it is possible to suppress the space of the supply path 38 from being narrowed upstream of the ribs 101 in the conveying direction. The cartridge ribs 130C also enable the paper P to be easily guided toward the actuator 100.

So far, an embodiment of the present invention has been described, but the present invention is not limited to the embodiment. The specific structures can be appropriately changed without departing from the intended scope of the present invention.

Figure 7A:
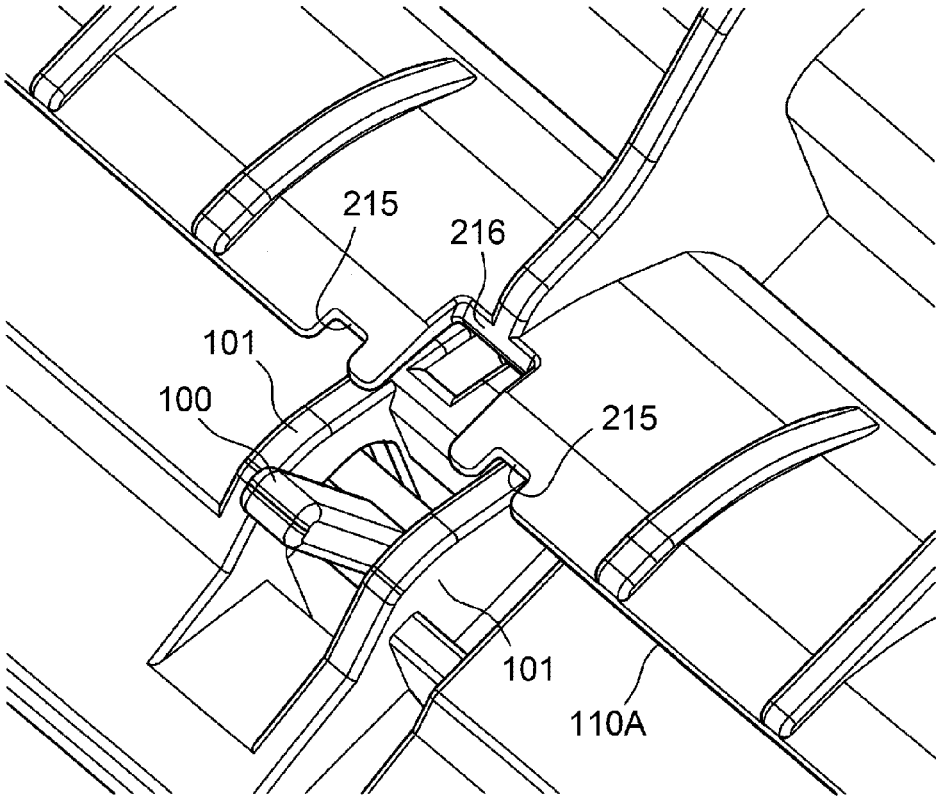
FIG. 7A is an enlarged perspective view of the actuator in a variation and its peripheral portions when viewed from above.
Figure 7B:
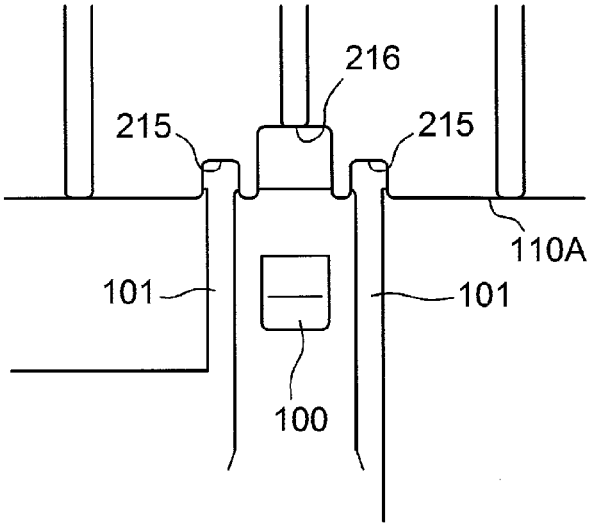
FIG. 7B is a view of the actuator and its peripheral portions when viewed directly above.

Although, in the embodiment described above, the second recess 116 has been disposed in the first recesses 115, the present invention is not limited to this. As illustrated in FIGS. 7A and 7B, first recesses 215 and a second recess 216, which is recessed upstream of the first recesses 215 in the conveying direction, may be independently provided. Alternatively, a second recess may not be provided.

Although, in the embodiment described above, the upper surface 101A of the rib 101 has crossed the abutting surface 100A of the actuator 100, the present invention is not limited to this. The upper surface 101A may not cross the abutting surface 100A Although, in the embodiment described above, the straight line L, which is tangent to both the ridge 130B and the downstream end 110A of the first guide 110, has crossed the abutting surface 100A of the actuator 100, the present invention is not limited to this. The straight line L may not cross the abutting surface 100A.

Although, in the embodiment described above, the third guide 130 has had the ridge 130B, the present invention is not limited to this. The third guide 130 may not have a ridge.

Although, in the embodiment described above, each guide rib 113A within the predetermined range W of the first guiding portion 111 has had the rib curved portion 114, the present invention is not limited to this. The guide rib 113A may not have a rib curved portion. Alternatively, the guide ribs 113A in the entire range of the first guiding portion 111 may have a rib curved portion.

Although, in the embodiment described above, each rib curved portion 114 has faced the ridge 130B, the present invention is not limited to this. The rib curved portion 114 may not face the ridge 130B.

Although, in the embodiment described above, the process cartridge 50 has been taken as an example of a cartridge, the present invention is not limited to this. A development cartridge attachable to and detachable from a process cartridge may be used.

Although, in the embodiment described above, paper P such as thick paper, a postcard, and thin paper has been taken as an example of a recording sheet, the present invention is not limited to this. The recording sheet may be, for example, an overhead projector (OHP) sheet.

Although, in the embodiment described above, the laser printer 1 has been taken as an example of an image forming apparatus. The present invention is not limited to this. For example, a color printer, a multi-function peripheral, or another type of image forming apparatus may be used.

What is claimed is:

1. An image forming apparatus comprising:

a feed tray configured to receive placement of a recording sheet;

an image forming unit configured to form an image on the recording sheet fed from the feed tray;

a first guide and a second guide which are configured to form a first conveying path through which the recording sheet fed from the feed tray is to be conveyed to the image forming unit in a conveying direction and to form a second conveying path which joins the first conveying path at a joining position, the first guide including a first guiding portion configured to guide the recording sheet conveyed through an upstream side of the first conveying path with respect to the joining position and also including a second guiding portion configured to guide the recording sheet conveyed through the second conveying path, the second guide including a third guiding portion that faces the second guiding portion of the first guide and that forms the second conveying path together with the second guiding portion of the first guide, the second guide further including a fourth guiding portion configured to guide the recording sheet conveyed through a downstream side of the first conveying path with respect to the joining position;

a third guide that faces the first guiding portion of the first guide and the fourth guiding portion of the second guide and that forms the first conveying path together with the first guiding portion of the first guide and the fourth guiding portion of the second guide;

an actuator that protrudes relative to the fourth guide portion toward the third guide, the actuator being pivotable less than 360 degrees and to be pivoted by the recording sheet conveyed through the first conveying path; and ribs which are disposed adjacent to the actuator in an axial direction of the actuator around which the actuator is pivotable, each of the ribs extending from the third guiding portion to the fourth guiding portion, a first rib of the ribs being disposed on a first side of the actuator in the axial direction and a second rib of the ribs being disposed on a second side of the actuator in the axial direction, wherein the first guide has a first recess which faces at least one of the ribs, the first recess being recessed in an upstream direction opposite to the conveying direction such that a non-recessed first portion of the first guide extends farther in the conveying direction than a second portion of the first guide forming the first recess.

2. The image forming apparatus according to claim 1, wherein the first guide has a second recess which faces the actuator, the second recess being more recessed in the upstream direction than the first recess such that the second portion of the first guide forming the first recess extends farther in the conveying direction than a third portion of the first guide forming the second recess.

3. The image forming apparatus according to claim 1, wherein when viewed from the axial direction, a protruding distance of each of the ribs is largest at a predetermined position where a surface of the actuator on an upstream side in the conveying direction crosses a surface of the rib that faces the third guide.

4. The image forming apparatus according to claim 1, wherein:

the third guide has a ridge disposed upstream of the joining position in the conveying direction, the ridge being curved in a convex form toward the first guide; and a straight line, which is tangent to both the ridge and a downstream end of the first guide when viewed from the axial direction, crosses a portion of the actuator that protrudes toward the third guide beyond the ribs.

5. The image forming apparatus according to claim 1, wherein:

the first guiding portion includes a plurality of guide ribs that extend in the conveying direction in such a way that the guide ribs are arranged in the axial direction; and of the plurality of guide ribs, a guide rib within a predetermined range in the axial direction in which the actuator is included has a rib curved portion that is curved in such a way that the guide rib is located farther away from the third guide than a guide rib placed outside the predetermined range in the axial direction.

6. The image forming apparatus according to claim 5, wherein:

the third guide has a ridge disposed upstream of the joining position in the conveying direction, the ridge being curved in a convex form toward the first guide; and the rib curved portion of the first guide faces the ridge.

7. The image forming apparatus according to claim 1, further comprising a cartridge which includes the third guide.

8. The image forming apparatus according to claim 1, further comprising a skew correcting unit that corrects a skew of the recording sheet conveyed to the image forming unit, the skew correcting unit being disposed downstream of the joining position in the conveying direction.

9. The image forming apparatus according to claim 1, wherein the second conveying path is a re-conveying path that guides the recording sheet with an image formed on one side toward the first conveying path.

10. The image forming apparatus according to claim 1, further comprising:

a discharge tray placed on an upper portion of a case, wherein the first conveying path is substantially U-shaped so as to extend from the feed tray toward the image forming unit; and a third conveying path on a downstream side of the image forming unit in the conveying direction and configured to curve the recording sheet on which an image has been formed by the image forming unit is curved and to guide the recording sheet to the discharge tray.

11. An image forming apparatus comprising:

a feed tray configured to receive placement of a recording sheet;

an image forming unit configured to form an image on the recording sheet fed from the feed tray;

a first guide and a second guide which are configured to form a first conveying path through which the recording sheet fed from the feed tray is to be conveyed to the image forming unit in a conveying direction, and to form a second conveying path which joins the first conveying path at a joining position, the first guide including a first guiding portion configured to guide the recording sheet conveyed through an upstream side of the first conveying path with respect to the joining position and also including a second guiding portion configured to guide the recording sheet conveyed through the second conveying path, the second guide including a third guiding portion that faces the second guiding portion of the first guide and that forms the second conveying path together with the second guiding portion of the first guide, the second guide further including a fourth guiding portion configured to guide the recording sheet conveyed through a downstream side of the first conveying path with respect to the joining position;

a third guide that faces the first guiding portion of the first guide and the fourth guiding portion of the second guide and that forms the first conveying path together with the first guiding portion of the first guide and the fourth guiding portion of the second guide;

an actuator that protrudes relative to the fourth guide portion toward the third guide, the actuator being configured to be pivoted by the recording sheet conveyed through the first conveying path; and ribs which are disposed adjacent to the actuator in an axial direction of the actuator around which the actuator is pivotable, each of the ribs extending from the third guiding portion to the fourth guiding portion;

wherein the first guide has a first recess which faces at least one of the ribs, the first recess being recessed in an upstream direction opposite to the conveying direction, wherein the first guiding portion includes a plurality of guide ribs that extend in the conveying direction in such a way that the guide ribs are arranged in the axial direction, and wherein, of the plurality of guide ribs, a guide rib within a predetermined range in the axial direction in which the actuator is included has a rib curved portion that is curved in such a way that the guide rib is located farther away from the third guide than a guide rib placed outside the predetermined range in the axial direction.

12. The image forming apparatus according to claim 11, wherein:

the third guide has a ridge disposed upstream of the joining position in the conveying direction, the ridge being curved in a convex form toward the first guide; and the rib curved portion of the first guide faces the ridge.

* * * * *